United States Patent [19]

Gillingham

[11] 4,351,567

[45] Sep. 28, 1982

[54] COWL-LIKE SCRUBBER FOR A LONG-WALL SHEARER

[75] Inventor: Gary R. Gillingham, Prior Lake, Minn.

[73] Assignee: Donaldson Company, Inc., Minneapolis, Minn.

[21] Appl. No.: 206,708

[22] Filed: Nov. 14, 1980

[51] Int. Cl.[3] ..... E21C 35/20

[52] U.S. Cl. ..... 299/45; 55/242; 55/257 PV; 55/258; 55/259; 55/385 D; 55/468; 55/473; 299/12; 299/81

[58] Field of Search ..... 299/12, 43, 45, 81; 55/223, 225, 233, 242, 257 PV, 258, 259, 385 D, 468, 473, 257 R

[56] References Cited

U.S. PATENT DOCUMENTS

| | | | |
|---|---|---|---|
| 2,111,266 | 3/1938 | Hopkins . | |
| 2,358,508 | 9/1944 | Hersh . | |
| 3,181,287 | 5/1965 | Rabson . | |
| 3,608,274 | 9/1971 | Stingelin et al. . | |
| 3,784,256 | 1/1974 | Katlic | 299/43 X |
| 3,785,625 | 1/1974 | Engalitcheff, Jr. et al. | 261/29 |
| 3,897,110 | 7/1975 | Agnew | 299/45 |
| 3,964,886 | 6/1976 | Engalitcheff, Jr. et al. | 55/228 |
| 4,068,802 | 1/1978 | Goings | 239/419.5 |
| 4,072,478 | 2/1978 | Regehr et al. | 55/440 |
| 4,140,501 | 2/1979 | Ekman | 55/242 |
| 4,175,933 | 11/1979 | James | 55/259 |
| 4,175,938 | 11/1979 | Regehr et al. | 55/440 |
| 4,249,778 | 2/1981 | McGuire | 299/12 X |

FOREIGN PATENT DOCUMENTS

| | | | |
|---|---|---|---|
| 1098706 | 1/1968 | United Kingdom | 299/45 |
| 1503690 | 3/1978 | United Kingdom | 299/45 |

OTHER PUBLICATIONS

Campbell, J. A. *Peabody Resolves Respirable Dust Emissions at Camp II,* in Mining Congress Journal, pp. 23–26, Mar. 1979.

*Primary Examiner*—Kathleen J. Prunner

*Attorney, Agent, or Firm*—Merchant, Gould, Smith, Edell, Welter & Schmidt

[57] ABSTRACT

A cowl-like scrubber (20) for removing dust generated by a longwall shearer has a housing (21) adapted to be mounted on the shearer near a cutter drum. An air inlet (23) is provided in the housing to allow the dust-laden air to enter the scrubber (20). Downstream from the inlet area is an arrangement of jet spray nozzles (30) which impart high velocity, small diameter water droplets. The water droplets entrain the dust particles in the dust-laden air and move the resulting dust-laden mist to a mist eliminator (40) downstream from the jet spray nozzles where the dust-laden mist is then removed from the air.

14 Claims, 5 Drawing Figures

COWL-LIKE SCRUBBER FOR A LONG-WALL SHEARER

TECHNICAL FIELD OF THE INVENTION

The present invention relates to a dust scrubber for use in mining operations, and in particular to a cowl-like scrubber adapted for use on a long-wall shearer to filter the dust-laden air generated in an underground mining operation.

BACKGROUND OF THE INVENTION

At the present time long-wall coal mining operations are generally limited to a "single-pass" technique in order to comply with government regulations for dust control. The single-pass technique allows mining only in the direction of the flow of ventilation air through the underground area. In this way, the mine workers who operate the shields and perform other mining related functions trail the generated dust and occupy an area of fresh air as the ventilation flow carries the dust forward, away from the miners. However, shearer operators may be exposed to dust generated by the trailing cutter drum. A long-wall shearer generally has two cutter drums, an upper, leading drum and a lower, trailing cutter drum. Since the trailing cutter drum is lower than the leading cutter, it generates less dust. This dust can be controlled by conventional techniques such as bit sprays located along the cutter drum periphery, special cutter drum bit shapes, reduced cutter drum revolution speeds and air moving sprays also known as "shearer clearers".

A major problem is encountered when attempts are made to mine in a direction opposite to or against the flow of ventilation air. In such an operation, the shearer operator is exposed to the dangerously high levels of dust generated by the upper cutter drum and carried back to the shearer operator by the ventilation air flow. Other miners are exposed to the dust generated by both cutter drums. To date, no satisfactory dust control technology has been developed which would allow long-wall coal mining in a direction against the ventilation flow without severely reducing cutting speeds in order to comply with governmental dust control regulations.

The problem remains despite a great economic incentive to develop the two-pass technique in order to increase a mine's productivity potential. Various types of dust collectors have been experimented with but have proven unsuccessful for a number of reasons. Foremost among the reasons is either the dust collectors could not remove sufficient quantities of dust from the air or the collectors or filters have been so large that their use is precluded by their vulnerability to damage or their interference with the mining operation itself.

The present invention allows increased coal production which in turn helps solve the national energy problem.

SUMMARY OF THE INVENTION

The present invention is a cowl-like scrubber which provides a practical solution to the long-wall mining dust control problem. The scrubber is adapted to be incorporated into the present cowl structures used in conjunction with the cutter drums on a long-wall shearer.

The scrubber has a housing which replaces a portion of the traditional cutter drum cowl and provides either a screen-like barrier or a solid surface adjacent the trailing edge periphery of the cutter drum. A barrier surface is necessary to protect the scrubber elements and the miners from chunks of coal thrown by the spinning drums as well as to enhance the augering function of the drums which moves coal away from the face of the wall on to the pan line. Downstream of the barrier surface are the water jet spray air movement means for entraining dust particles within water droplets thereby creating a dust-laden mist, and a mist eliminator which then removes the dust-laden mist from the air, effectively filtering the air to meet dust control regulations for the safety of the miners.

According to one aspect of the invention, the water jet spray air movement means includes an arrangement of nozzles fed with a water supply for producing jet sprays of high pressure, high velocity water droplets for effective contact with the dust-laden air generated by the drums.

According to another aspect of the invention, the barrier surface may be a screen of a porous, non-plugging type which performs the normal functions of a conventional cowl and allows dust particles to pass through to the scrubber elements. If a screen is used water sprays are provided for flushing the front and back sides of the screen to unplug any portions of the screen preventing air flow therethrough.

According to another aspect of the invention, the barrier surface may be a solid surface similar to the traditional cowl used for cutter drums. The air to be filtered would then be directed around the sides, over the top, or around the bottom of the solid surface into the scrubber elements for filtering.

According to another aspect of the invention, the mist eliminator may be a fibrous media panel, i.e. a packed bed-type filter, or a tortuous path demister, used either singly or in cooperation.

According to another aspect of the invention, auxiliary sprays may be provided to an area near the forward portion of the cutter drum for directing the generated dust back towards the cowl-like scrubber. Such auxiliary sprays would be most helpful when the shearer is operating in the direction of the ventilation air flow.

DETAILED DESCRIPTION OF THE PREFERRED EMBODIMENT

Figure 1:
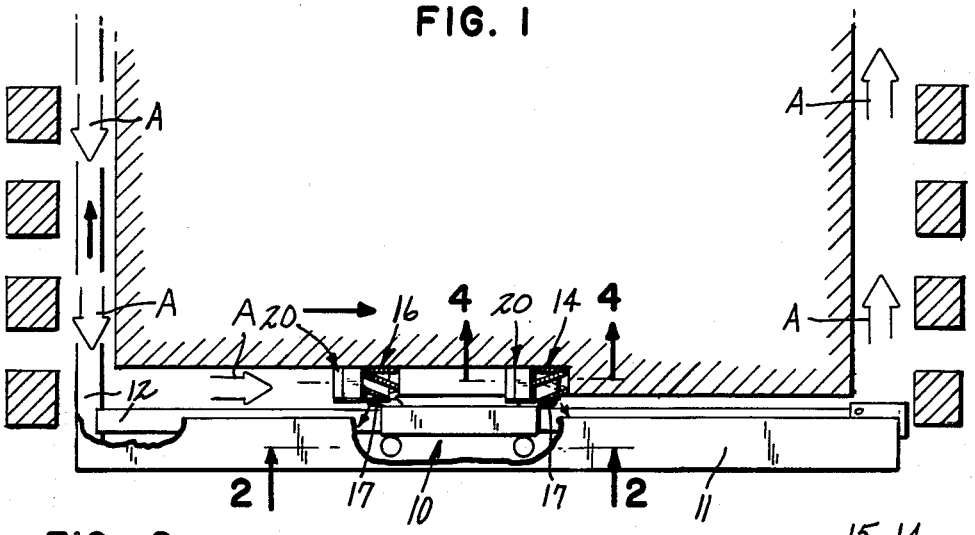
FIG. 1 is a top plan view of a long-wall shearer operating in the direction of the ventilation air flow in an underground mine, partially shown in horizontal cross-section.

Referring now to the drawings, like reference numerals designate identical or corresponding parts throughout the several views. The preferred embodiment is directed specifically to a coal mine operation; nonetheless, the present invention has broad application to types of mining other than coal. FIG. 1 shows a long-wall mining operation. The periphery of the wall of coal is defined by the flow path for the ventilation air illustrated by the directional arrows A. Within the flow path area are a stage loader and a pan line for the conveyance of the mined coal to the conveyor leading to the exterior of the mine. Along the pan line 12 runs the longwall shearer 10, which is protected from collapsing mined areas (the gob area) by shields 11. The main frame 13 of the shearer supports a pair of cutter drums, a leading cutter drum 14 and a trailing cutter drum 16. The cutter drums auger into the coal wall and thus mine the coal. The direction of operation of the shearer is shown in FIG. 1 as proceeding with the direction of the ventilation air flow. This is the standard single-pass technique arrangement. However, it is to be understood that the present invention is directed to effective filtering of the dust-laden air when the shearer is operating against the ventilation air flow as well as with the air flow. For purposes of complete disclosure only, the operation of the shearer with the flow of ventilation air was chosen.

Figure 2:
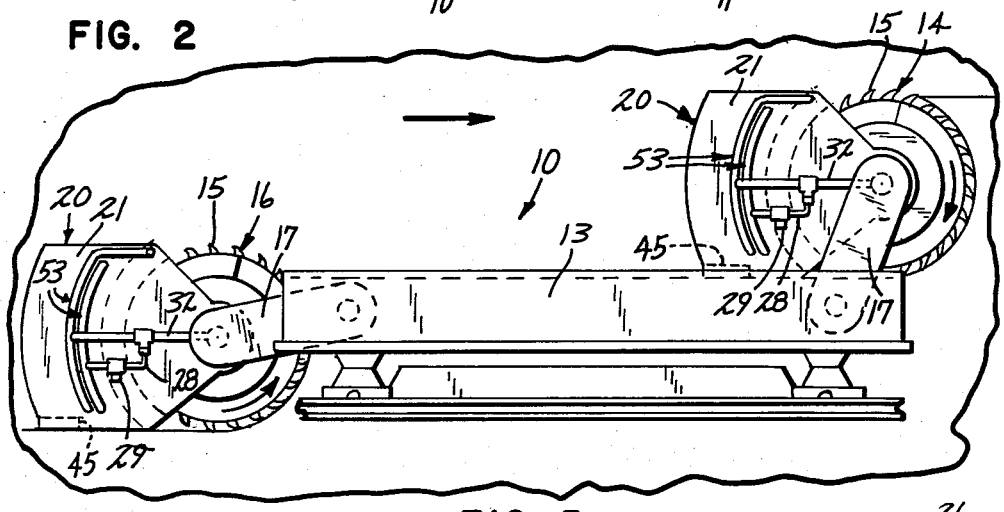
FIG. 2 is a fragmentary elevational view of the invention as seen along line 2—2 in FIG. 1.

Referring now to FIG. 2, the main frame 13 of the shearer 10 is shown with the present invention 20 mounted with respect to both the upper, leading cutter drum 14 and lower, trailing cutter drum 16. The support arms 17 for connecting the scrubbers 20 to the main frame 13 are also shown. The cutter drums revolve in clockwise and counterclockwise directions into portions of the coal wall. The traditional rearward cowl for each cutter drum is shown with the present invention, a cowl-like scrubber 20, incorporated into its structure.

Figure 3:
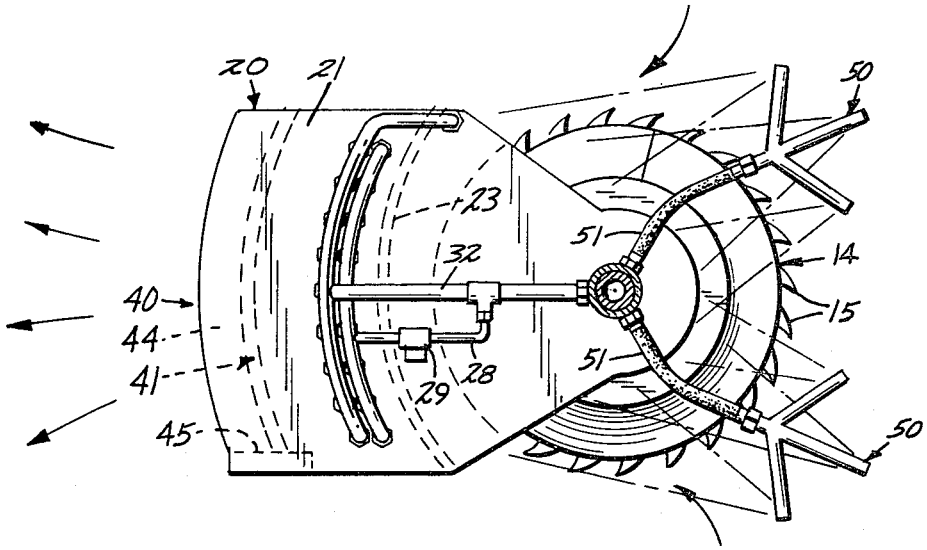
FIG. 3 is a side elevational view of the present invention and a cutter drum.

In FIG. 3, the spatial relationship of the cowl-like scrubber invention 20, hereafter referred to as the scrubber, with the cutter drum 14, is shown. The housing 21 has mounted within it the various water supply piping 28, 32, 50, 51, and manifold means 53 necessary for the operation of this scrubber. The water supplies will be discussed in greater detail below. The drum bits 15 are arranged in a helical fashion on the drum which is not apparent from the drawing in FIG. 3.

Figure 4:
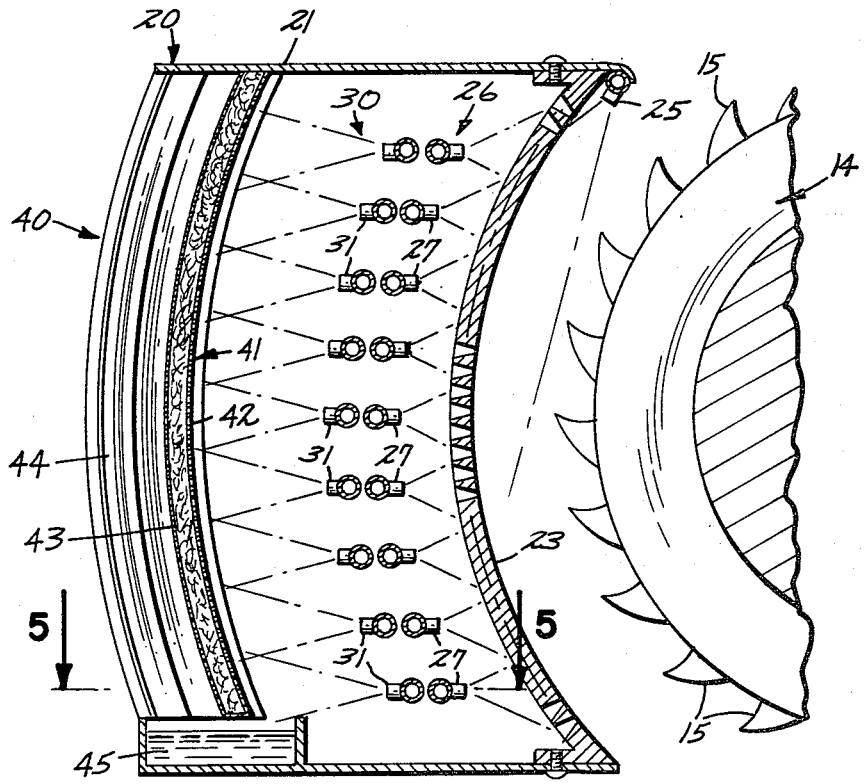
FIG. 4 is a cross-sectional side view of the present invention as seen along line 4—4 in FIG. 1.

The structure of the scrubber can be understood most clearly from a discussion of FIG. 4. In FIG. 4, only a portion of the leading cutter drum 14 is shown. The portion shown is the trailing edge of the cutter drum 14. Directly behind the trailing edge the traditional cowl structure was mounted. In the present invention a cowl-like structure remains but incorporated in it is the dust scrubber invention. The cowl provides a surface to the cutter drum which enhances the augering or coal conveying function of the cutter drum as well as providing protection to the shearer operators from coal fragments or chunks thrown from the rotating drum. In FIG. 4, a screen-like barrier 23 mounted over the air inlet to the housing 21 occupies the normal cowl position. The use of a screen or similar porous barrier is optional, but a screen-like barrier 23 is preferred. The screen-like barrier 23 is an intake screen constructed preferably from a durable, non-plugging media. The barrier 23 thus can function as a normal cowl yet is porous to let air and dust pass through for the filtering process. The openings of the screen would be small enough to prevent coal particles which are large enough to plug other scrubber elements from passing through. It should be understood that if a solid surface cowl is used, the intake locations for the dust to enter the scrubber could be located on the side of the scrubber away from the coal face or along the top or bottom surfaces of the scrubber.

To prevent the intake barrier 23 from plugging, even though a non-plugging media is used, water sprays are used. As shown in FIG. 4, water sprays 25 are provided along the top edge of the barrier 23 to continuously or intermittently flush the outside screen surface and thereby preventing plugging. Backflush sprays 26 with nozzles 27 are provided directly behind the barrier in the event the screen of the barrier 23 becomes plugged to an extent the surface sprays 25 cannot clean. The backflush sprays 26 are activated automatically by a pressure switch 29. The pressure switch would sense the air pressure in the scrubber downstream of the intake screen 23. The pressure switch 29 would be connected to a standard solenoid valve. Other air velocity sensing devices could be used to provide the automatic backflushing function. The water supply for the surface sprays 25, however, would be separated from the supply for the backflush sprays 26 because the two sprays would not be operated at the same time. The front surface sprays 25 would operate regularly as opposed to the intermittent operation of the backflush sprays 26.

An alternative barrier would be a solid cowlpiece which would prevent flying coal pieces from passing to the scrubber elements but would be designed to permit dust-laden air flow around its edges to the scrubber elements.

Figure 5:
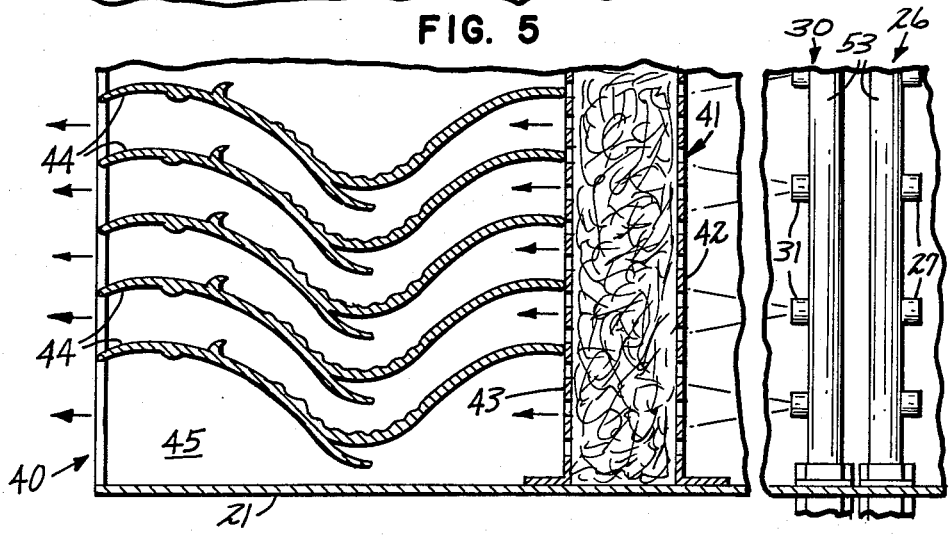
FIG. 5 is a cross-sectional view of a portion of the present invention as seen along line 5—5 in FIG. 4.

Arranged in an aligned manner with the backflush spray nozzles 27, back-to-back, are the nozzles 31 of the jet spray air movement section 30 of the scrubber 20. The nozzles 31 are constructed to deliver high pressure, high velocity water droplets and are spaced apart along the entire depth of the scrubber and across the entire width of the scrubber as can be seen in a comparison of FIG. 4 and FIG. 5. The nozzles 31 are directed to shoot water jets in the direction away from the cutter drum. The water supply 32 for both the jet spray air movement section 30 and the front screen surface sprays 25 may be interconnected. An alternative embodiment is a pipe having a continuous lengthwise slot capable of spraying high velocity water droplets.

A short distance from the jet spray air movement section 30 in the nozzle spray direction is positioned a mist consolidator and/or eliminator element 40. In FIG. 4, a fibrous media panel 41 provides a surface 42 for collecting the dust-laden mist. It is a filter media well-known by those in the art, as is the wave blade demister 44 which is mounted immediately behind at the downstream rearwad side 43 of the fibrous panel 41 and is better seen in FIG. 5. The wave-blade demister is thus downstream from the fibrous panel 41 and provides additional mist collection. A standard sump 45 can be provided at the bottom of the mist removal section 40 to collect the resulting water slurry. Multiple sumps would be used if the mist collection rate is relatively high. The multiple sumps would be mounted so as to divide the demister section 40 into shorter vertical sections and thereby reduce the likelihood of water carry-through. It should be understood, however, that other demister devices could be used for the demisting function including other tortuous path, cyclone, turning vane, packed bed demisters or zigzag demisters. And a single mist eliminator device could be used rather than the combination of demisters shown in this preferred embodiment.

When cutting in the direction of ventilation airflow as shown in FIG. 1, the dust would likely be carried away from the scrubber. To eliminate that tendency, auxiliary air movement means can be used. In one embodiment, water spray means 50 are mounted at various locations around the cutter drum; see FIG. 3. The water supply for the spray means 50 could be provided from the supply used in the existing cutter bit cooling and dust suppression sprays. The water spray means 50 would cause a local air velocity directed towards the scrubber intake regardless of the direction of ventilation airflow, with respect to the shearer operation, thus aiding the dust cloud capture efficiency of the scrubber 20. Flexible spray supports 51 such as piping, tubing, or hinged arms, capable of withstanding impacts from flying coal chunks would be used. An alternative embodiment, not shown, for the auxiliary air movement means would be the use of duct enclosures mounted near the cutter drum which would capture the generated dust-laden air and direct the flow back to the scrubber area.

As described above, the present dust scrubber invention is a compact filtering device requiring only a source of water to move the dust-laden air. This is a significant improvement from the familiar venturi-type scrubbers which typically relay on a fan to move both the water and air and which are too large and long for any practical use in underground mining applications.

OPERATION OF THE PREFERRED EMBODIMENT

A cutter drum of a long-wall shearer generates a tremendous amount of dust which in the confined area of an underground mine operation must be removed by the ventilation air flow or other means to meet the safety standards necessary for mine safety. The present scrubber invention provide a compact design and effective filtering of cutter generated dust.

The amount of airflow required to collect a given quantity of cutter generated dust is a mathematical function of the distance of the scrubber or filter pickup point from the cutter drum. The concentration of dust in the air (expressed as mass/air volume) decreases rapidly as the distance from the dust generation point (the cutter drum) increases. In general, then, to collect a given quantity of dust per unit of time, a filter or scrubber pickup located far from the cutter drum would have to have a higher airflow rate than would a filter or scrubber with its pickup (air intake) close to the drum where the concentration of dust in the air is higher. Placing the scrubber intake point as close as possible to the cutter drum then requires the smallest possible amount of airflow necessary to collect a given quantity of dust per unit of time. In turn, such an intake location would allow the use of the smallest possible effective scrubber design. With a typical long-wall shearer, the closest possible dust pickup point to the revolving cutter drum would be at the cowl. The cowl is normally located only a few inches from the drum.

The present invention, a cowl-like scrubber, is incorporated into the traditional cowl location and could be attached to a conventional cowl. Through use of water spray means 50 the generated dust cloud is directed into or towards the intake screen 23 which is kept clear by use of surface sprays 25 or backflush sprays 26. Once the dust-laden air has passed through the barrier 23, it enters jet spray air movement region 30 to begin the removal process.

It is estimated that a 5,000 to 10,000 cubic feet per minute airflow rate is required at the cowl scrubber intake location to effectively control the respirable dust problem. The movement of this quantity of air through th cowl-like scrubber 20 is induced by the water jet spray air movement section 30 by use of nozzles 31. The induction of air with water sprays is known in the art. Venturi scrubbers are used in the art to contact particulate with water droplets. The present invention uses jet spray air movement to make efficient use of water to move the dust-laden air, and effectively contact the coal particulate with water droplets as well as to fit within a very limited space. A large quantity of fine sprays generating high velocity, small diameter water droplets are necessary to meet these design requirements.

In order for a moving droplet to induce air movement, an exchange of momentum must take place. The more a water droplet is slowed by the air, the greater the momentum exchange and the greater the energy increase of the dust-laden air. Fast moving water droplets have a higher drag force and therefore lose velocity more rapidly than do slow moving water droplets. It follows then that the higher the initial velocity of the water droplets, the greater the momentum exchange in a given distance. It is known that the chances of contact between a water droplet and a dust particle are increased as the relative velocity between the two is increased. Thus, the higher the initial droplet velocity, the more effective the droplet is at contacting dust particles.

The present invention uses high droplet velocities to achieve the two desirable results of high momentum transfer and effective droplet/particle contact. It achieves high droplet velocities by delivering high pressure water to the nozzles 31. The mathematical relationships between droplet discharge velocity ($V_1$) and the nozzle pressure (P) for an ideal nozzle is represented by the following formula:

$$V_1 = 12.2\sqrt{P}$$

where $V_1$ is in ft/sec and P is in lb/in$^2$. In the present invention it has been determined that for a practical scrubber, the nozzle discharge velocity should be at least three times greater than the mean air velocity ($V_2$) in the area between the jet spray air movement nozzles and the demister. Therefore, to have an effective cowl-like scrubber design the following mathematical relationship should be followed:

$$\frac{\sqrt{P}}{V_2} > 0.25$$

where P is again expressed in lb/in$^2$ and $V_2$ is in ft/sec.

Given time, the tiny dust-laden droplets generated by the jet spray air movement section 30 would evaporate and the entrained dust particles would be released back into the air, an undesirable result. Therefore, the dust-laden droplets are quickly removed and/or consolidated into larger droplets which quickly settle as a result of gravitational forces. The fibrous media panel 41 has a high respirable dust removal efficiency as it brings dust particulate which escaped water droplet impingement in the jet spray air movement section 30 into more intimate direct contact with the water than would a wave-blade or zigzag demister alone. A fibrous media panel does have a typically high pressure drop for a given approach velocity and a tendency to allow large droplets to be generated and thrown into the airstream at its downstream surface 43; however, these large droplets will quickly fall to the mine floor carrying dust particulate with them.

Where the higher dust removal efficiency possible with a fibrous media panel is required but the large droplet carry-through is objectionable, the wave-blade demister 44 is placed downstream on the rearward side 43 of the fibrous media panel 41 to catch the water droplets generated at the downstream panel surface 43. If used, the sump 45 then collects the water slurry produced from the panel 41 collection and the wave-blade demister 44.

As stated earlier, the scrubber effectively filters the cutter generated dust whether the shearer is operating in the direction of ventilation air flow or against the ventilation air flow. The water spray means 50, though, are provided and operated to direct the dust toward the scrubber intake area regardless of the direction of shearer operation. Even when cutting in a direction opposite to the ventilation air, the spray means 50 help prevent the dust from following the mined coal away from the coal wall and would redirect the dust back into the scrubber. The flexible supports 51 would "give" under the occasional impact from the mined coal and other objects and would thus avoid damage causing inoperation of the spray means 50.

It can now be appreciated that the present invention for a cowl-like scubber overcomes the dust problems of an underground mining operation and provides a practical solution to the long-wall shearer dust control problems.

What is claimed is:

1. In combination with a long-wall shearer used in underground mining operations, said shearer having a cylindrical cutter drum with a leading side which shears the coal wall and a trailing side, a cowl-like scrubber to block large particulate material and capture dust particles generated by said cutter drum, said cowl-like scrubber comprising:

a housing on said shearer proximate said trailing side of said cutter drum, said housing having an inlet extending along a substantial portion of said trailing side, said inlet being constructed and arranged to receive a substantial portion of dust-laden air resulting from operation of said long-wall shearer;

water jet spray air movement means in said housing for entraining within water droplets shearer-generated dust particles passing through said inlet to create a dust-laden mist within said housing;

dust-laden mist removal means positioned downstream from and in fluid communication with said jet spray air movement means;

said housing including barrier means positioned intermediate and apart from said cutter drum and said air movement means, substantially along a major portion of said cutter drum trailing side, for preventing larger particles from entering said scrubber;

said water jet spray air movement means including a plurality of high pressure nozzles mounted in spaced apart relationship across the depth and width of said housing intermediate said mist removal means and said barrier means, said nozzles directing high velocity jet sprays of water droplets into said dust-laden air, moving said air away from said cutter drum, and further including means for providing a water supply to each of said nozzles, whereby dust-laden air in said underground mining operation is effectively filtered.

2. A water-powered dust scrubber adapted to be mounted on a long-wall shearer, said shearer having a cutter drum which generates large particulate material and dust particles, said scrubber comprising:

a housing;

means on said housing for mounting said housing in close spaced-apart relationship with a trailing side of said cutter drum;

means, proximate said trailing side of said cutter drum, for establishing dust-laden air movement through said housing in a direction away from said cutter drum trailing side including water jet sprays in said housing, said air movement means including a plurality of nozzles constructed and arranged across the depth and width of said housing to direct high velocity, small diameter water droplets into said shearer-generated dust particles within said housing so as to entrain said dust particles within said water droplets, said jet spray air movement means also including a water supply means for said nozzles;

dust-laden mist removal means positioned downstream from and in fluid communication with said jet spray air movement means; and barrier means on said housing positioned behind said cutter drum trailing side and upstream from said jet spray air movement means for preventing larger particles from entering said housing with said dust-laden air.

3. In combination with a long-wall shearer used in underground mining operations, said shearer having a cylindrical cutter drum with a leading side which shears the coal wall and a trailing side, a cowl-like scrubber to block large particulate material and capture dust particles generated by said cutter drum, said cowl-like scrubber comprising:

a housing on said shearer proximate said trailing side of said cutter drum, said housing having an inlet for dust-laden air;

water jet spray air movement means in said housing for entraining within water droplets shearer generated dust particles to create a dust-laden mist;

dust-laden mist removal means positioned downstream from and in fluid communication with said jet spray air movement means, said dust-laden mist removal means including a tortuous path means for removing said dust-laden water droplets from said dust-laden air and including a fibrous panel of filter media secured adjacent said air movement means; and said housing including barrier means intermediate said cutter drum and said air movement means for preventing larger particles from entering said scrubber;

whereby said dust-laden air in said underground mining operation is effectively filtered.

4. In combination with a long-wall shearer used in underground mining operations, said shearer having a cylindrical cutter drum with a leading side which shears the coal wall and a trailing side, a cowl-like scrubber to block large particulate material and capture dust particles generated by said cutter drum, said cowl-like scrubber comprising:

a housing on said shearer proximate said trailing side of said cutter drum, said housing having an inlet for dust-laden air;

water jet spray air movement means in said housing for entraining within water droplets shearer generated dust particles to create a dust-laden mist;

dust-laden mist removal means positioned downstream from and in fluid communication with said jet spray air movement means, said dust-laden mist removal means including a tortuous path means which includes a wave-blade mist eliminator; and said housing including barrier means intermediate said cutter drum and said air movement means for preventing larger particles from entering said scrubber; whereby dust-laden air in said underground mining operation is effectively filtered.

5. In combination with a long-wall shearer used in underground mining operations, said shearer having a cylindrical cutter drum with a leading side which shears the coal wall and a trailing side, and a cowl-like scrubber to block large particulate material and capture dust particles generated by said cutter drum, said cowl-like scrubber comprising:

a housing on said shearer proximate said trailing side of said cutter drum, said housing having an inlet for dust-laden air;

water jet spray air movement means in said housing for entraining within water droplets shearer generated dust particles to create a dust-laden mist;

dust-laden mist removal means positioned downstream from and in fluid communication with said jet spray air movement means, said dust-laden mist removal means including a tortuous path means for removing said dust-laden water droplets from said dust-laden air;

said housing including barrier means intermediate said cutter drum and said air movement means for preventing larger particles from entering said scrubber; and sump means on said housing proximate said tortuous path means for collecting dust-laden water removed from said air;

whereby dust-laden air in said underground mining operation is effectively filtered.

6. In combination with a long wall shearer used in underground mining operations, said shearer having a cylindrical cutter drum with a leading side which shears the coal wall and a trailing side, and a cowl-like scrubber to block large particulate material and capture dust particles generated by said cutter drum, said cowl-like scrubber comprising:

a housing on said shearer proximate said trailing side of said cutter drum, said housing having an inlet for dust-laden air;

water jet spray air movement means in said housing for entraining within water droplets shearer generated dust particles to create a dust laden mist;

dust-laden mist removal means positioned downstream from and in fluid communication with said jet spray air movement means; and said housing including barrier means intermediate said cutter drum and said air movement means for preventing larger particles from entering said scrubber, said barrier means including a porous filter screen, said screen providing a surface area proximate a peripheral portion of said cutter drum trailing side; whereby dust-laden air in said underground mining operation is effectively filtered.

7. The combination according to claim 6, said barrier means further including flushing spray means mounted intermediate said screen and said cutter drum proximate said screen, said flushing means including a plurality of water spray nozzles directed toward said screen surface area proximate said cutter drum, each said water spray nozzle operatively connected to a water supply.

8. The combination according to claim 6, said barrier means further including a plurality of reverse flow water spray nozzles directed towards a backside of said screen for dislodging particles from said screen, said water spray nozzles each operatively connected to a water supply and to control means for activating said reverse water flow from said nozzles.

9. In combination with a long-wall shearer used in underground mining operations, said shearer having a cylindrical cutter drum with a leading side which shears the coal wall and a trailing side, a cowl-like scrubber to block large particulate material and capture dust particles generated by said cutter drum, said cowl-like scrubber comprising:

a housing on said shearer proximate said trailing side of said cutter drum, said housing having an inlet for dust-laden air;

water jet spray air movement means in said housing for entraining within water droplets shearer-generated dust particles to create a dust-laden mist;

dust-laden mist removal means positioned downstream from and in fluid communication with said jet spray air movement means;

said housing including barrier means intermediate said cutter drum and said air movement means for preventing larger particles from entering said scrubber; and auxiliary air movement means positioned adjacent said cutter drum leading side for directing said dust-laden air into said cowl-like scrubber; whereby dust-laden air in said underground mining operation is effectively filtered.

10. The combination according to claim 9 wherein said auxiliary air movement means includes a plurality of spaced apart nozzles mounted to said cutter drum, each said nozzle directed in the direction of said cowl-like scrubber.

11. A water-powered dust scrubber adapted to be mounted on a long-wall shearer, said shearer having a cutter drum which generates large particulate material and dust particles, said scrubber comprising:

a housing;

means on said housing for mounting said housing in close spaced-apart relationship with a trailing side of said cutter drum;

means proximate said trailing side of said cutter drum for establishing dust-laden air movement through said housing in a direction away from said cutter drum trailing side including water jet sprays in said housing for entraining within high velocity water droplets the shearer-generated dust particles within said housing, thereby creating a dust-laden mist;

dust-laden mist removal means positioned downstream from and in fluid communication with said jet spray air movement means, said mist removal means including a tortuous path type demister formed as a fibrous media panel for removing said dust-laden water droplets from said dust-laden air; and barrier means on said housing positioned behind said cutter drum trailing side and upstream from said jet spray air movement means for preventing larger particles from entering said housing with said dust-laden air.

12. A water-powered dust scrubber adapted to be mounted on a long-wall shearer, said shearer having a cutter drum which generates large particulate material and dust particles, said scrubber comprising:

a housing;

means on said housing for mounting said housing in close spaced-apart relationship with a trailing side of said cutter drum;

means proximate said trailing side of said cutter drum for establishing dust-laden air movement through said housing in a direction away from said cutter drum trailing side including water jet sprays in said housing for entraining within high velocity water droplets the shearer-generated dust particles within said housing, thereby creating a dust-laden mist;

dust-laden mist removal means positioned downstream from and in fluid communication with said jet spray air movement means, said mist removal means including a wave-blade, tortuous path type demister for removing said dust-laden water droplets from said dust-laden air; and barrier means on said housing positioned behind said cutter drum trailing side and upstream from said jet spray air movement means for preventing larger particles from entering said housing with said dust-laden air.

13. A water-powered dust scrubber adapted to be mounted on a long-wall shearer, said shearer having a cutter drum which generates large particulate material and dust particles, said scrubber comprising:

a housing;

means on said housing for mounting said housing in close spaced-apart relationship with a trailing side of said cutter drum;

means proximate said trailing side of said cutter drum for establishing dust-laden air movement through said housing in a direction away from said cutter drum trailing side including water jet sprays in said housing for entraining within high velocity water droplets the shearer-generated dust particles within said housing, thereby creating a dust-laden mist;

dust-laden mist removal means positioned downstream from and in fluid communication with said jet spray air movement means, said dust-laden mist removal means including a fibrous media panel for collecting water droplets proximate said jet spray air movement nozzles, said panel having a downstream side which is positioned adjacent a wave-blade demister for removing from the air water droplets leaving said panel; and barrier means on said housing positioned behind said cutter drum trailing side and upstream from said jet spray air movement means for preventing larger particles from entering said housing with said dust-laden air.

14. A water-powered dust scrubber adapted to be mounted on a long-wall shearer, said shearer having a cutter drum which generates large particulate material and dust particles, said scrubber comprising:

a housing;

means on said housing for mounting said housing in close spaced-apart relationship with a trailing side of said cutter drum;

means proximate said trailing side of said cutter drum for establishing dust-laden air movement through said housing in a direction away from said cutter drum trailing side including water jet sprays in said housing for entraining within high velocity water droplets the shearer-generated dust particles within said housing, thereby creating a dust-laden mist;

dust-laden mist removal means positioned downstream from and in fluid communication with said jet spray air movement means;

barrier means on said housing positioned behind said cutter drum trailing side and upstream from said jet spray air movement means for preventing larger particles from entering said housing with said dust-laden air; and sump means proximate said dust-laden mist removal means for collecting a resulting water slurry.

* * * * *